US010782019B2

(12) United States Patent
Savage et al.

(10) Patent No.: US 10,782,019 B2
(45) Date of Patent: Sep. 22, 2020

(54) WET SCRUBBING HIGH RUBBER GRAFT ABS PARTICULATE VENT VAPORS

(71) Applicant: SABIC GLOBAL TECHNOLOGIES B.V., Bergen op Zoom (NL)

(72) Inventors: Thomas Howard Savage, Lowell, AR (US); Allen Lee White, Newburgh, IN (US); Jianhua Xu, Newburgh, IN (US); Richard F. Legg, Vienna, WV (US); Frank Jefferson Simmons, Pass Christian, MS (US); Rajeshkumar M. Patel, Jubail Industrial City (SA); Mohammed F. Masyakhi, Riyadh (SA); Faisal Al-Ahmari, Riyadh (SA); Saud Al Shahrani, Riyadh (SA); Vern Lowry, Ottawa, IL (US)

(73) Assignee: SABIC GLOBAL TECHNOLOGIES B.V., Bergen op Zoom (NL)

( * ) Notice: Subject to any disclaimer, the term of this patent is extended or adjusted under 35 U.S.C. 154(b) by 193 days.

(21) Appl. No.: 15/562,073

(22) PCT Filed: Mar. 25, 2016

(86) PCT No.: PCT/EP2016/056695
§ 371 (c)(1),
(2) Date: Sep. 27, 2017

(87) PCT Pub. No.: WO2016/156261
PCT Pub. Date: Oct. 6, 2016

(65) Prior Publication Data

US 2018/0073734 A1 Mar. 15, 2018

Related U.S. Application Data

(60) Provisional application No. 62/140,295, filed on Mar. 30, 2015.

(51) Int. Cl.
*F23G 5/02* (2006.01)
*F23J 15/04* (2006.01)
*F23G 7/06* (2006.01)

(52) U.S. Cl.
CPC ..... *F23G 5/02* (2013.01); *F23G 7/068* (2013.01); *F23J 15/04* (2013.01); *F23J 2217/50* (2013.01)

(58) Field of Classification Search
CPC ..... B01D 50/008; B01D 47/06; B01D 47/12; F23G 5/02; F23G 7/068; F23G 7/06; F23G 2201/60
(Continued)

(56) References Cited

U.S. PATENT DOCUMENTS 4,375,976 A * 3/1983 Potter ..... B01D 50/008 150/4.02
2005/0229780 A1 10/2005 Spink et al.
(Continued)

FOREIGN PATENT DOCUMENTS

JP 5765724 B2 8/2015
WO 2005080872 A1 9/2005

OTHER PUBLICATIONS

International Search Report for International Application No. PCT/EP2016/056695; International Filing dated Mar. 25, 2016; Date of Mailing: Jun. 30, 2016; 5 Pages.
(Continued)

*Primary Examiner* — Thuan D Dang
(74) *Attorney, Agent, or Firm* — Cantor Colburn LLP

(57) ABSTRACT

The disclosure concerns a system for the removal of particulate from a waste vapor stream from a hydrocarbon production process. The particulate can be removed from the waste vapor stream using a series of water streams and gravity separation.

20 Claims, 1 Drawing Sheet

(58) Field of Classification Search
USPC ..... 96/234, 236, 240, 290
See application file for complete search history.

(56) References Cited

U.S. PATENT DOCUMENTS

| | | | |
|---|---|---|---|
| 2006/0138579 | A1 | 6/2006 | Shin et al. |
| 2010/0263535 | A1 | 10/2010 | Andersen et al. |

OTHER PUBLICATIONS

Written Opinion of the International Searching Authority for International Application No. PCT/EP2016/056695; International Filing dated Mar. 25, 2016; Date of Mailing: Jun. 30, 2016; 5 Pages.
Chinese Office Action for the corresponding Chinese Application No. 201680019662.0; dated Apr. 2019, English translation, 8 pages.

* cited by examiner

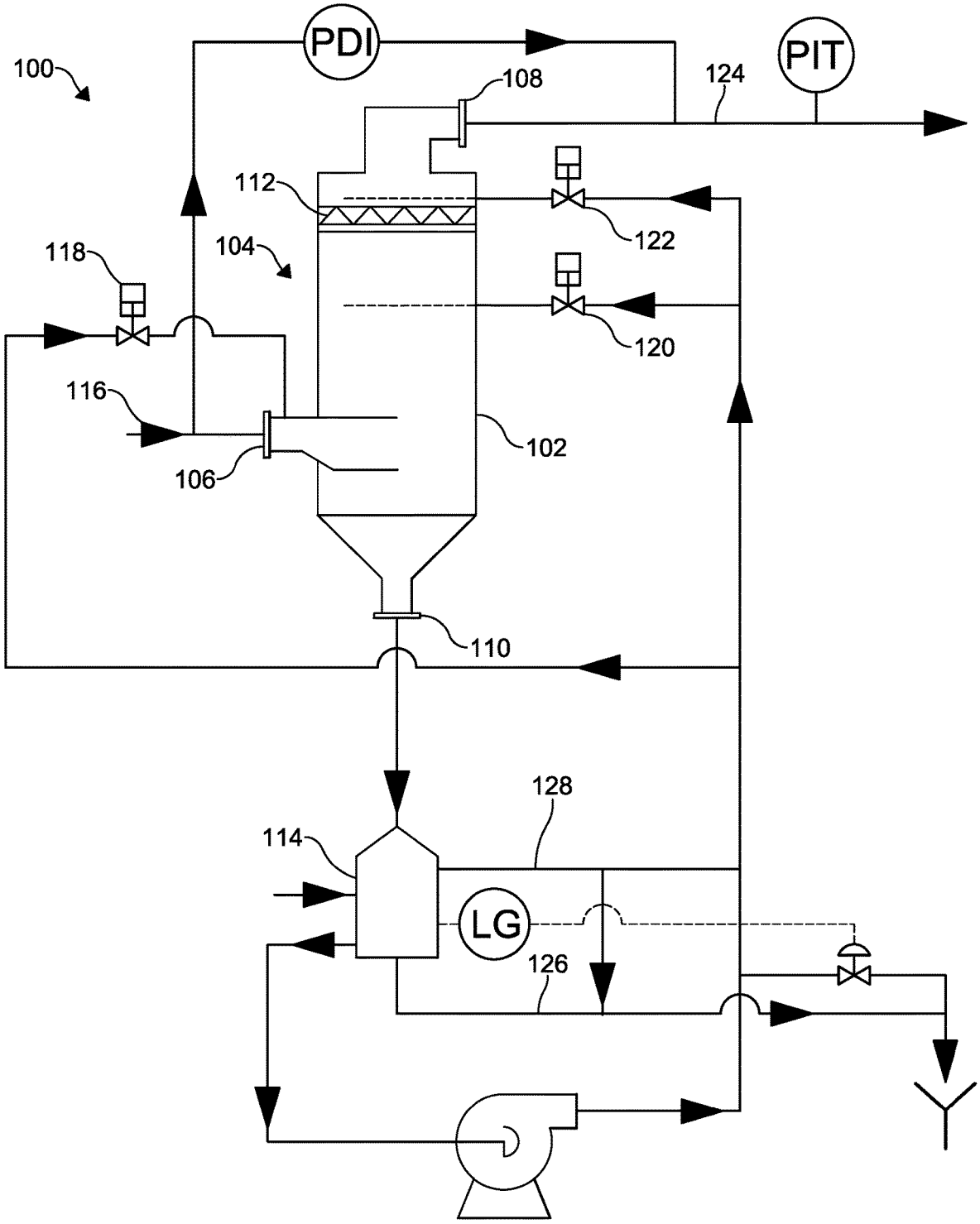
100
PDI
PIT
108
124
112
122
118
104
120
116
102
106
110
128
114
LG
126

WET SCRUBBING HIGH RUBBER GRAFT ABS PARTICULATE VENT VAPORS

RELATED APPLICATION

This application is a 371 of International Application No. PCT/EP2016/056695, filed Mar. 25, 2016, which claims priority to U.S. application 62/140,295, filed Mar. 30, 2015 which are incorporated herein by reference in their entirety.

TECHNICAL FIELD

The disclosure concerns a particulate removal system for waste vapors generated in the production of a copolymer resin.

BACKGROUND

Scrubbers are widely used in the chemical production industry to scrub gas streams of undesirable components from releasing into the atmosphere of for removal of waste products. In the preparation of the copolymer resins, such as acrylonitrile butadiene styrene (ABS) resin, significant amounts of waste gas, water, and solids can be produced. These residual byproducts can be of environmental concern. Often, the discharge of an ABS facility must meet the environmental guidelines in place for removal of this waste or the processing this waste before releasing to the atmosphere.

SUMMARY

ABS resin production can generate environmentally harmful process gases. These process gases can be subject to stringent environmental protocol prohibiting their emission into the surrounding atmosphere. Accordingly, resin processing plants can incorporate pollution control mechanisms, such as a Regenerative Thermal Oxidizer (RTO). Unfortunately, a waste vapor stream containing these process gases can further comprise very tiny and combustible high rubber graft (HRG) ABS particles. These small particles of the vapor stream can ignite as the vapor is transported for treatment in the RTO from an HRG ABS dryer and a succeeding dust collector. Accordingly, it would be beneficial to provide a system for removing the combustible HRG ABS particles from a vapor stream of process gas in an ABS plant.

As described in more detail herein, the present disclosure provides processes, apparatuses, and systems for removing particulate and chemical pollutants from a vapor stream of a hydrocarbon chemical process in a material production plant).

The present disclosure relates to a scrubber system for removing combustible particulate and pollutants from a vapor stream of an ABS resin production plant. Further, the present disclosure relates to a wet scrubber system for removing combustible particulate from a waste vapor stream in an ABS resin production plant prior to combustion of the waste vapor stream.

In various aspects, the present disclosure relates to a system of directing a hydrocarbon chemical process waste vapor stream through a vessel equipped with at least a water stream.

BRIEF DESCRIPTION OF THE FIGURES

FIG. 1 depicts a schematic of the wet scrubber system.

DETAILED DESCRIPTION

The present disclosure can be understood more readily by reference to the following detailed description of the disclosure and the Examples included therein.

Waste vapors of a hydrocarbon chemical processing plant can contain harmful environmental pollutants. Environmental policies and occupational safety protocols can restrict the introduction of these vapors into the surrounding atmosphere of these plants. Accordingly, pollution control devices, such as a Regenerative Thermal Oxidizer (RTO), can be utilized to combust the waste vapors emitted in these facilitates. RTO can refer to a pollution reduction system which may include a bed of ceramic material used to absorb heat from exhaust gas. The captured heat can then be used to preheat an incoming process gas stream and destroy pollutants emitted from the process exhaust streams at temperatures ranging from 815° C. (1,500° F.) to 980° C. (1,800° F.). Processing plants for the preparation of ABS typically exhibit low chemical emissions from high rubber graft emulsion ABS dryers. Nevertheless, the waste vapor stream can contain small, highly reactive (combustible) HRG dust particles. These particles can be small enough to pass through dust collecting apparatuses disposed in the processing system. The small, combustible particles can ignite or explode within the piping system of the plant that directs the waste vapor stream from the HRG ABS dryer to the RTO. In various aspects of the present disclosure, the waste vapor stream of the HRG ABS production can be scrubbed to remove these combustible particulate and other contaminants prior to treatment in the RTO.

In an aspect, a particulate control system, via a wet scrubber, can be used to remove the combustible particulate from a waste vapor stream of a hydrocarbon production plant prior to combustion of the waste vapor stream.

The present disclosure can provide a system configured for the removal of particulate and contaminant in a pre-combustion waste vapor of a hydrocarbon process via a gravity separation. The system of the present disclosure can comprise a wet scrubber. The wet scrubber can comprise a vessel, a series of water streams, a vapor inlet, a particulate outlet, and a mist filter.

The system disclosed herein can reduce a waste vapor stream containing 23.1 kilograms per hour (kg/hr) or about 23.1 kg/hr of volatile organic compounds and about 18.15 kg/hour of particulate to a resultant vapor stream containing 10 milligrams per Normal cubic meter (mg/Nm$^3$) or about 10 mg/Nm$^3$ of particulate. Normal may refer to normal conditions wherein a normal cubic meter of gas corresponds to 1 cubic meter at 20° C. at 101.325 kPaA (absolute pressure, kilopascals). More specifically, prior to treatment within the scrubber system, the waste vapor stream can contain 7.95 kg/hour or about 7.95 kg/hour of particulate having a particle size distribution of from 0.1 micrometer (μm) to 10 μm, or from about 1 μm to about 10 μm, and 10.2 kg/hour or about 10.2 kg/hour of particulate having a particle size distribution of from 0.05 millimeters (mm) to 5 mm, or from about 0.05 mm to about 5 mm, observed according to commercial mesh (MESH) sieve dimensions as in ISO 565 (1990). Even more specifically, the total amount of particulate of the waste vapor stream can be reduced to 10 mg/Nm$^3$ or to about 10 mg/Nm$^3$ of particulate having a particle size distribution of from 0.1 μm to 500 μm (or from about 1 μm to about 500 μm), or having a particle size distribution of from 0.1 μm to 150 μm (or from about 1 μm to about 150 μm), or having a particle size distribution of from 0.1 μm to 50 μm (or from about 0.1 μm to about 50

μm), or having a particle size distribution of from 0.1 μm to 10 μm (or from about 0.1 μm to about 10 μm).

Acrylonitrile Butadiene Styrene Production

The present disclosure relates to an acrylonitrile butadiene styrene (ABS) resin production process comprising the disclosed wet scrubber system. In a further aspect, the ABS resin production process can be configured to incorporate the disclosed wet scrubber system. In a yet further aspect, the ABS production system can comprise the disclosed wet scrubber system and can be configured to perform the disclosed processes and systems.

In one aspect, the preparation of a high rubber graft (HRG) ABS copolymer resin can comprise grafting styrene and acrylonitrile monomers onto a polybutadiene latex rubber substrate in a batch or continuous polymerization process. In further aspects, the ABS copolymer resin can be prepared by blending emulsion latexes of styrene acrylonitrile (SAN) and nitrile rubber (NBR). In an example, the polymerization process to yield an ABS resin can proceed through an ABS latex phase. The ABS latex phase can be further processed to provide the desired ABS resin.

The high rubber graft ABS copolymer can be prepared by polymerization processes including emulsion, suspension, sequential emulsion-suspension, bulk and solution polymerization processes. These methods are known in the polymerization art, specifically directed toward the preparation of a wide variety of high rubber graft copolymers for impact modification of thermoplastic resins. Suitable specific embodiments of the particular impact modifiers can be prepared by any aforementioned polymerization means. Preferred polymerization processes can proceed in an aqueous media and include emulsion and suspension methods. The preferred process for preparing the rubbery portion can be by way of emulsion polymerization as taught in the art. In one example, a graft (emulsion) polymerization to provide an grafted rubber latex (e.g., an ABS latex), can include charging a reactor system with a substrate such as a diene rubber latex (polybutadiene latex), adding a first portion of at least one of a styrene and one of an acrylonitrile to the polybutadiene latex, adding to the reaction system over a predetermined time a catalyst (a radical initiator) and a second portion of at least one of acrylonitrile and styrene monomers, and polymerizing the catalyzed reaction mixture of polybutadiene latex, styrene and acrylonitrile. The graft polymerization process can also include an emulsifier to facilitate formation of the grafted ABS copolymer resin.

In an aspect, the polymerization process can afford a copolymer resin wherein at least 30 percent by weight, or at least about 30 percent by weight, of the rigid polymeric phase is chemically bound or grafted to the rubbery polymeric phase. In a still further aspect, at least 45 percent by weight, or at least about 45 percent by weight, of the rigid polymeric phase is chemically bound or grafted to the rubbery polymeric phase. In a further aspect, the HRG ABS has rubber content greater than or equal to 50 wt. % by weight, or about 50 wt. % by weight, of the graft polymer. In some aspects, the HRG ABS can have a rubber content less than or equal to 95 wt. % by weight, or less than or equal to about 95 wt. % by weight, of the graft polymer. In one aspect, the produced HRG ABS can also have a mean particle size of 100 microns (μm) to 500 microns, or about 100 μm to about 500 μm.

The HRG ABS can be prepared by graft polymerizing less than 50 wt. %, or less than about 50 wt. %, of at least one rigid monomer such as a vinyl aromatic monomer, an acrylic monomer, a vinyl nitrile monomer or a mixture thereof in the presence of more than 50 wt. %, or more than about 50 wt. %, of a preformed rubbery polydiene substrate such as 1,3-diene polymer or copolymer thereof. In particular, the graft copolymers can comprise from 50 wt. % to 90 wt. %, or from about 50 wt. % to about 90 wt. %, of a rubbery substrate polydiene such as for example polybutadiene latex to provide a graft ABS latex. As an example, the generated ABS latex can be further processed via coagulation using a salt or caustic acid to provide an output ABS slurry. During the coagulation process, fine particulates agglomerate or clump together and accumulate at the top or settle at the bottom of the slurry. The agglomerated particles can be separated or harvested via a filtration or centrifuge process to remove water and provide an output wet ABS resin. The wet ABS resin can then be dried under heat to remove moisture and provide the final ABS copolymer resin.

A number of drying techniques can be utilized in the production system to reduce the residual moisture of the wet ABS resin. In a further aspect, the removal of moisture can require the application of dry air and heat. The drying process can be carried out in a number of ways, including, but not limited to, open system dryers having a stream of fresh, heated air as a dryer medium, semi-open air circulation dryers with a partial supply of fresh air, and desiccant dryer systems having a desiccant chamber to adsorb moisture from the dryer medium. For example, in an open system heated, air can flow through a fluid bed of ABS resin granules or pellets. The heated air flow up from the bed of granules can heat the granules while carrying away the moisture. Hygroscopic resins, however, such as ABS, however can exhibit less moisture reduction in an open air system. In a semi-open drying system, the heated air can be recirculated through a piping system. In another example, the desiccant dryer system can include a desiccant chamber through which the heated dryer medium (heated air) passes before heating the polymer resin.

In various aspects, the drying process of an ABS resin can release volatile organic compounds. Volatile process gases including, but not limited to, styrene, acrylonitrile, and butadiene can be released from the resin. A dryer vent system can be utilized to carry the undesirable waste vapors away for combustion of the pollutant vapors. In an example, the dryer vent can comprise barrels configured to pull the generated waste vapors. As a further example, the dryer vent system can comprise duct work that can carry the dry ABS resin and air from a dryer discharge to a dryer dust collector inlet. In the dryer dust collector, the ABS resin can be separated from the air except to the extent that particles of ABS pass through a series of dust collector bags or pass through defective connections between the bags and a tube sheet that separates the ABS containing portion of the dust collector and a clean air plenum of the dust collector. The clean air can flow through the plenum into a duct that leads to a dust collector fan. The fan can induce the flow through the entire dryer system and can discharge the air to the wet scrubber system. Air exiting the scrubber (that is, scrubbed air) can then flow from the scrubber to the RTO.

ABS production can generate high rubber graft ABS particles. As noted herein, the resultant polymer can have a rubber particle size of from 100 μm to 500 μm, or from about 100 μm to about 500 μm. However, the vents of ABS dryers can contain fine powder HRG ABS particles. The tiny particles can be combustible and can ignite within the volatile vapors of the waste vapor stream as the waste vapors are transferred through the vents for combustion. In one aspect, a wet scrubber system as disclosed herein can be configured to receive the waste vapors of the dryer vent system prior to combustion.

Wet Scrubber System

The waste vapor streams produced in an HRG ABS process can contain pollutants such as acrylonitrile, styrene, butadiene, and other organic compounds as well as small, combustible dust particles (particulate) of fine HRG ABS powder. In an example, the composition of the gas stream can generally comprise the following:

| Component | Weight Percent (wt. %) |
|---|---|
| 1,3 Butadiene | 0.0013 |
| Acrylonitrile | 0.0001 |
| Styrene | 0.0025 |
| Methyl Methacrylate | 0.0005 |
| Cumene | 0.0333 |
| Ethyl Benzene | 0.006 |
| 2-Butene | 0.0022 |
| 4-Vinyl cyclohexene | 0.0037 |
| Water Vapor | 5 |
| Nitrogen | 73 |
| Oxygen | 22 |

The waste vapor stream can be introduced to a Regenerative Thermal Oxidizer (RTO) to combust the waste vapor into carbon dioxide and water. However, the combustible nature of the HRG powder particles requires that these particulate be removed prior to transportation to the oxidizer. It is desirable to remove the explosive particulate prior to combustion in the RTO to prevent ignition in piping systems that deliver the waste vapor from the ABS dryer venting to the RTO. Generally, an RTO may refer to a thermal oxidizer employed in industrial processes for the treatment of exhaust air. An exemplary RTO may comprise a bed of ceramic material to absorb energy, or heat, from exhaust gas or from a waste vapor stream as used herein. The captured heat may then be used to preheat an entering exhaust gas, or waste vapor, and to eliminate pollutants within the exhaust gas, or waste vapor.

As illustrated in FIG. 1, a vessel 102 can comprise a housing 103 which can define an internal cavity 104. The internal cavity 104 can be configured to have a vertical axis A-A. One or more vapor inlets 106 can be formed through the housing 103 and configured to direct a waste vapor stream 116 into the internal cavity 104. A mist filter 112 can be disposed within the internal cavity 104. The mist filter 112 can be configured to separate water and a first amount of particulate from the waste vapor stream 116. A plurality of water inlets, 118, 120, and 122 can be formed through the housing 103 and configured to introduce water into the internal cavity 104. A plurality of water inlets 118, 120, and 122 may refer to two or more water inlets configured to introduce water into the internal cavity 104. As an example, the plurality of water inlets 118, 120, and 122 may refer to three water inlets. The plurality of water inlets 118, 120, and 122 can be in fluid communication with a plurality of water valves 119, 121, and 123, to provide controlled flow to the water inlets 118, 120, and 122. The introduced water can mix with the waste vapor stream 116 as the waste vapor moves along the vertical axis of the internal cavity 104. A particulate outlet 110 can be formed through the housing 103 and configured to direct at least a portion of the water and a second amount of particulate to exit the internal cavity 104. A vapor outlet 108 can be formed through the housing 103 and configured to allow at least a portion of the waste vapor to exit the internal cavity 104.

In an aspect, a waste vapor stream 116 can enter the vapor inlet 106 and a first water stream can be introduced via a first water inlet 118 operated by a first water valve 119. A second water inlet 120 can direct a second water stream into the housing 103. The second water inlet 120 can be disposed between the vapor inlet 106 and a mist filter 112. A third water inlet 122 can direct a third water stream into the housing 103, the third water stream disposed between the mist filter 112 and a vapor outlet 108. The waste vapor stream 116 can travel up from the vapor inlet 106 through the water streams and mist filter 112 out through the vapor outlet 108 to provide a resultant vapor stream 124. The resultant vapor stream 124 can be directed via piping to a reactor for reductive thermal oxidation. As the waste vapor stream 116 travels through the water streams and mist filter 112, water and any particulate from the waste vapor stream 116 can flow down, via gravity separation, to the particulate outlet 110. The resultant particulate and water can be directed to a water collection tank 114 from the particulate outlet 110. The water collection tank 114 can have drain system 126 and an overflow system 128. The drain system 126 can be configured to allow for removal of solid particulate that collects at the bottom of the water collection tank 114. The overflow system 128 of the water container tank 114 can also contain particulate. Finally, in various further aspects, the drain system 126 and overflow system 128 can be configured to redirect portions of water from the water collection tank 114 to the plurality of water inlets 118, 120, and 122 via control of at least one of the first water valve 119, second water valve 121, or third water valve 123 for reintroduction into the housing 103.

As water streams enter the housing 103, a separation of particulate from the entering waste vapor stream 116 can occur. This separation can be attributed to gravity because of the disparity in the specific gravities of the vessel 102 contents. The water and particulate can have a greater specific density than that of the waste vapor stream 116. The water streams entering the housing 103 and the waste vapor stream 116 can interact such that as the waste vapor 116 travels up through the housing 103, water and undesired particulate can fall down the housing 103 and through the particulate outlet 110. The particulate and water mixture, forming a so described "scrubber liquid," can travel to a water collection tank 114 upon exiting the particulate outlet 110. Meanwhile, the waste vapor can travel through the mist filter 112 and out of the vessel through the vapor outlet. As the particulate and water mixture fill the water collection tank 114, particulate can settle at the bottom of the water collection tank 114. Particulate that is less dense than water can further settle at the surface of the water within the water collection tank 114. The settled particulate can enter the drain system 126. In one example, the wet scrubber system 100 can be configured so that scrubber liquid removed from a mid-level volume of the water collection tank 114 can be reintroduced into the vessel 102 at a water inlet of the plurality of water inlets 118, 120, 122. In a further example, the scrubber liquid can be reintroduced into the housing 103 in a water stream via the first water inlet 118 adjacent the vapor inlet 106. In a yet further example, the scrubber liquid can be reintroduced into the vessel at a water inlet adjacent the mist filter, that is, a water stream entering from the second water inlet 120 or the third water inlet 122.

In an aspect, the vessel 102 can vary in range, from, for example, 28.32 cubic meters, $m^3$, (1000 cubic feet, $ft^3$) or about 28.32 $m^3$, to as large as 226.53 $m^3$ (8000 $ft^3$) or about 226.53 $m^3$. It will be understood that other vessels of different volumes can also be used for the scrubber process and can be easily and/or conveniently scaled for industrial treatment of a waste vapor. As an example, the vessel 102 can have a capacity of at least 101.94 $m^3$ (3600 $ft^3$) or at least about 101.94 $m^3$, liquid volume occupied. The volume of the vessel 102 can refer to the internal volume of the housing 103 available for occupation by the liquid and vapor containing the applicable reagents. In various further aspects, the vessel 102 can be so configured to be capable of operating at from −13 kiloPascal Gauge (kPaG) to 10 kPaG, or from about 13 kPaG to about 10 kPaG. In another aspect, the vessel 102 can comprise a variety of suitable materials of construction. For example, the housing 103 can comprise fiberglass reinforced plastic, aluminum, polypropylene plastics, carbon steel, stainless steel, other alloy steels, among other materials. Stainless steel can refer to a carbon and iron alloy, or metallic mixture, including at least 10.5%, or at least about 10.5%, chromium by weight. In one example, the vessel 102 can comprise 316 grade stainless steel having a minimum thickness of 4.8 mm, or about 4.8 mm.

As disclosed herein, the wet scrubber system 100 of the present disclosure can comprise a mist filter 112. The mist filter 112 can be situated at a first end of the vertical housing 103. In various aspects, the mist filter 112 can have a surface oriented up towards the first end of the housing 103 and the vapor outlet 108. Additionally, the mist filter 112 can have its opposite surface oriented down toward the particulate outlet 110. In a further aspect, the mist filter 112 can be configured to remove moisture from the waste vapor stream 116 travelling through the housing 103 and out of the vapor outlet 108. The mist filter 112 can comprise a high efficiency mesh pad medium. In certain aspects, the mist filter 112 may be corrosion resistant, that is, the mist filter may comprise a material that may be able to withstand gradual degradation in the environment of the wet scrubber system. In further aspects, the mist filter 112 may be able to withstand a range of temperatures, more specifically, the temperatures at which the wet scrubber system is operated. In an example, the mist filter 112 can comprise a metal filter pad. By means of further example, and in no way limiting the disclosure, the mist filter 112 metal filter pad can comprise stainless steel, or more specifically, 316 grade stainless steel.

In various aspects, the vessel 102 of the wet scrubber system 100 can further comprise a plurality of water inlets 118, 120, and 122. Each water inlet can introduce a water stream (or streams) into the housing 103 via a control valve 119, 121, or 123. The valves 119, 121, and 123 can control the flow of fluid into the housing through one or more of the plurality of water inlets 118, 120, 122. For example, the water stream can enter the housing through a pressurized spray nozzle assembly at a water inlet. In another example, the spray nozzle assembly can comprise stainless steel, more specifically, 316 grade stainless steel. Much like the first water inlet 118 can direct a first water stream into the housing 103, at least a second water inlet 120 and a third water inlet 122 can also introduce water streams into the housing 103 via a pressurized nozzle. In an aspect, the second water inlet 120 and third inlet 122 can be configured to introduce a second and third series of water streams into the housing 103 adjacent to a mist filter 112. The water streams of the second water inlet 120 and third water inlet 122 entering the vessel through spray nozzles can be configured to direct water streams onto a surface of the mist filter 112. In an example, the second water inlet 120 can be configured such that the water stream is disposed adjacent the mist filter 112 at the surface of the mist filter 112 oriented down towards the particulate outlet 110. Furthermore, the third water inlet 122 can be disposed such that water streams from the inlet can be adjacent the mist filter 112 at the surface of the mist filter 112 oriented up towards to vapor outlet 108. Thus the water streams of the second water inlet 120 and third water inlet 122 can provide backwash spray on the mist filter 112, thereby cleansing the filter of particulate and allowing for a continued waste vapor flowthrough.

In some aspects, a wet scrubber system 100 of the present disclosure can comprise the vessel 102 as disclosed herein in addition to an aerator equipped with another set of water streams. The aerator may be configured to deliver the waste vapor into the vessel 102. The additional aerator can be joined adjacent to the vessel 102 described above such that the waste vapor stream 116 can travel through the additional aerator and into the vessel 102 described above. As an example, the aerator can comprise a submersible pump combined with a single or twin diffuser pipes. The aerator can be housed in a similarly upright vessel (hereinafter, aerator vessel) comprising a first end and a second end and a plurality of water inlets. A waste vapor inlet of the aerator vessel can be situated at the first end of the aerator vessel. The waste vapor stream can be pressurized and forced down through the aerator and out of an outlet of the aerator vessel and into the vessel of the wet scrubber. In a further example, the wet scrubber of the present disclosure can comprise a venturi scrubber. The venturi scrubber can include a venturi shaped chamber with converging and diverging sections. The venturi scrubber can employ a concurrent flow of water and waste vapor at an inlet of the scrubber. The flow of water can induce the venturi effect and can provide an additional force. This additional force can direct the air from a dust collector to the scrubber. The ensuing contact between the water and the waste vapor stream can also remove particulate from the waste vapor stream prior to the entrance of the water and waste vapor stream into the scrubber itself. In one example, the venturi scrubber can be an ejector venturi scrubber, where a single high pressure, high pressure nozzle is used to generate the force within the scrubber.

In some aspects, the flow rate and pressure of the water streams through the wet scrubber system 100 can be modified. The flow rate of the water from the second water inlet 120 and third water inlet 122, controlled by a second water valve 121 and a third water valve 123, respectively, can be maintained at about 40 meters cubed per hour ($m^3$/hour) (or about 20 $m^3$/hour for two nozzles). In a further example, the flow rate of the water from the second water inlet 120 and third water inlet 122, controlled by a second water valve 121 and a third water valve 123, respectively, can be maintained at 40 meters cubed per hour ($m^3$/hour) (or 20 $m^3$/hour for two nozzles). The pressure of the second water inlet 120 and third water inlet 122 can be maintained at 200 kPaG, or about 200 kPaG. In one example, wherein the wet scrubber system further comprises a venturi apparatus, the water flow at a venturi inlet can be maintained at 71 $m^3$/hour (or 17.7 $m^3$/hour across 4 nozzles). In further aspects wherein the wet scrubber system further comprises a venturi apparatus, the water flow at a venturi inlet can be maintained at about 71 $m^3$/hour (or about 17.7 $m^3$/hour across about 4 nozzles).

A rate of introduction of water at a water inlet of the plurality of water inlets 118, 120, 122 and the rate of exit of water through the particulate outlet 110 can be configured such that there is no accumulation or depletion of water in the vessel 102. That is, the rate of the flow of water introduced and exiting the plurality of water inlets 118, 120, 122 may be the same, nominally the same, or about the same.

Additional components including a level gauge (LG), pressure indication transmitter (PIT), and pressure differential indication (PDI) can be in line with the flow path of the wet scrubber system 100.

In various aspects of the present disclosure, the wet scrubber system 100 can reduce the amount of particulate matter present in a waste vapor stream 116 directed through the wet scrubber system 100. In one example, a waste vapor stream 116 of an acrylonitrile butadiene production system can contain high rubber graft ABS powder particles of varying sizes. More specifically, a waste vapor stream 116 can contain 18.15 kg/hr, or about 18.15 kg/hr, of particulate, of which 7.95 kg/hr, or about 7.95 kg/hr, of the particulate can be described as "fine" HRG ABS powder. As used herein, fine refers to a particle size distribution of from 0.1 μm 10 μm or from about 0.1 μm about 10 μm. Fine particle size can also refer to a particle size of from 0.1 μm to 500 μm (or from about 1 μm to about 500 μm), or a particle size of from 0.1 μm to 150 μm (or from about 1 μm to about 150 μm), or a particle size of from 0.1 μm to 50 μm (or from about 0.1 μm to about 50 μm), or a particle size of from 0.1 μm to 10 μm (or from about 0.1 μm to about 10 μm).

The waste vapor stream 116 can enter the vapor inlet 106 and travel through the housing 103, exiting at the vapor outlet 108 to provide a resultant vapor stream 124. The resultant vapor stream can have a maximum solid outlet concentration of 10 mg/Nm$^3$, or about 10 mg/Nm$^3$. For the resultant vapor, having a gas molecular weight of 27.92 g/mol, 10 mg/Nm$^3$ corresponds to 1 kg/hr, or about 1 kg/hr, for example 1.0079 kg/hr, indicating a percent reduction of 95%, or about 95%.

In various aspects of the present disclosure, the particulate present in a waste vapor stream may be of a certain size. Generally, the particulate is a solid, having a defined size and shape. As such, the size of these particles may be measured according to a number of appropriate techniques. Exemplary techniques for assessing particulate size may include light scattering, laser diffraction optical microscope, Scanning Electron Microscopy (SEM), Transmission Electron Microscopy (TEM), Atomic Force Microscopy (AFM), electroacoustic techniques. Commercial MESH sieve dimensions related to particle size may also be applicable and are referenced as in ISO 565 (1990). As a further example, a spectrophotometer, such as a Thermo Scientific Genesys 20 spectrophotometer, may be used to measure particle size.

While typical embodiments have been set forth for the purpose of illustration, the foregoing/following descriptions should not be deemed to be a limitation on the scope herein. Accordingly, various modifications, adaptations, and alternatives can occur to one skilled in the art without departing from the spirit and scope herein.

It is to be understood that the terminology used herein is for the purpose of describing particular aspects only and is not intended to be limiting. As used in the specification and in the claims, the term "comprising" can include the embodiments "consisting of" and "consisting essentially of" Unless defined otherwise, all technical and scientific terms used herein have the same meaning as commonly understood by one of ordinary skill in the art to which this disclosure belongs. In this specification and in the claims which follow, reference will be made to a number of terms which shall be defined herein.

As used in the specification and the appended claims, the singular forms "a," "an" and "the" include plural referents unless the context clearly dictates otherwise. Thus, for example, reference to "a ketone" includes mixtures of two or more ketones.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent 'about,' it will be understood that the particular value forms another aspect. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. It is also understood that each unit between two particular units are also disclosed. For example, if 10 and 15 are disclosed, then 11, 12, 13, and 14 are also disclosed.

The disclosed systems and methods include at least the following aspects.

Aspect 1. A vessel for removal of particulate in pre-combustion waste vapor of an acrylonitrile butadiene styrene process, the vessel comprising: a vapor inlet configured to introduce waste vapor into the vessel; a mist filter disposed in the vessel and configured to minimize a moisture within the waste vapor in the vessel; a plurality of water inlets configured to introduce water into the vessel; a particulate outlet configured to control exit of at least the water and a particulate from the vessel; and a vapor outlet configured to control exit of at least the waste vapor from the vessel.

Aspect 2. A vessel for removal of particulate in pre-combustion waste vapor of an acrylonitrile butadiene styrene process, the vessel consisting essentially of: a vapor inlet configured to introduce waste vapor into the vessel; a mist filter disposed in the vessel and configured to minimize a moisture within the waste vapor in the vessel; a plurality of water inlets configured to introduce water into the vessel; a particulate outlet configured to control exit of at least the water and a particulate from the vessel; and a vapor outlet configured to control exit of at least the waste vapor from the vessel.

Aspect 3. A vessel for removal of particulate in pre-combustion waste vapor of a processing system, the vessel consisting of: a housing defining an internal cavity having a vertical axis; a vapor inlet formed through the housing and configured to direct a waste vapor into the internal cavity; a mist filter disposed in the internal cavity and configured to separate water and a first amount of particulate from the waste vapor; a plurality of water inlets formed through the housing and configured to introduce water into the internal cavity, the water mixing with the waste vapor as the waste vapor moves along the vertical axis of the internal cavity; a particulate outlet formed through the housing and configured to direct at least a portion of the water and a second amount of particulate to exit the internal cavity; a vapor outlet formed through the housing and configured to allow at least a portion of the waste vapor to exit the internal cavity, wherein the waste vapor is processed in the internal cavity and the portion of the waste vapor exiting the internal cavity comprises less than 10 mg/Nm$^3$, or less than about 10 mg/Nm$^3$ of particulate.

Aspect 4. A vessel for removal of particulate in pre-combustion waste vapor of a processing system, the vessel consisting essentially of: a housing defining an internal cavity having a vertical axis; a vapor inlet formed through the housing and configured to direct a waste vapor into the internal cavity; a mist filter disposed in the internal cavity and configured to separate water and a first amount of particulate from the waste vapor; a plurality of water inlets formed through the housing and configured to introduce water into the internal cavity, the water mixing with the waste vapor as the waste vapor moves along the vertical axis of the internal cavity; a particulate outlet formed through the housing and configured to direct at least a portion of the water and a second amount of particulate to exit the internal cavity; a vapor outlet formed through the housing and configured to allow at least a portion of the waste vapor to exit the internal cavity, wherein the waste vapor is processed in the internal cavity and the portion of the waste vapor exiting the internal cavity comprises less than 10 mg/Nm$^3$, or less than about 10 mg/Nm$^3$ of particulate.

Aspect 5. The vessel of any of aspects 1-4, wherein the particulate has a size of from 0.1 μm to 10 μm, or from about 0.1 μm to about 10 μm.

Aspect 6. The vessel of any of aspects 1-5, wherein one or more of the first amount of particulate and the second amount of particulate comprises a particulate having a size of from 0.1 μm to 10 μm, or from about 0.1 μm to about 10 μm.

Aspect 7. The vessel of any of aspects 1-5, wherein one or more of the first amount of particulate and the second amount of particulate comprises a particulate having a size of from 0.1 μm to 10 μm, or from 0.1 μm to 500 μm.

Aspect 8. The vessel of any of aspects 1-5, wherein one or more of the first amount of particulate and the second amount of particulate comprises a particulate having a size of from about 0.1 μm to about 10 μm, or from about 0.1 μm to about 500 μm.

Aspect 9. The vessel of any of aspects 1-8, wherein the mist filter comprises stainless steel.

Aspect 10. The vessel of any of aspects 1-9, wherein a rate of introduction of water at a water inlet of the plurality of water inlets and the rate of exit of water through the particulate outlet is the same.

Aspect 11. The vessel of any of aspects 1-9, wherein a rate of introduction of water at a water inlet of the plurality of water inlets and the rate of exit of water through the particulate outlet is configured such that there is no accumulation or depletion of water in the system.

Aspect 12. A method for removal of particulate in pre-combustion waste vapor of an acrylonitrile butadiene styrene process, the method comprising: introducing a first stream of water into a first water inlet of a housing oriented on a vertical axis and having a first end and a second end, the housing having a vapor outlet and a particulate outlet, the vapor outlet disposed at the first end of the housing, and the particulate outlet disposed and the second end, and the housing having a mist filter disposed at the first end of the housing and adjacent the vapor outlet; introducing a waste vapor into a vapor inlet of the vessel, the vapor inlet disposed between the particulate outlet and the mist filter; introducing a second stream of water from a second water inlet into the vessel, the second water inlet disposed between the vapor inlet and the mist filter; introducing a third stream of water from a third water inlet into the vessel, the third water inlet disposed between the mist filter and the vapor outlet; directing the introduced waste vapor along the vertical axis from the vapor inlet through one or more of the first water stream, second water stream, and third water stream, and the mist filter, and through the vapor outlet to provide a resultant vapor stream; directing the resultant vapor stream to a regenerative thermal oxidizer; and collecting a particulate from the waste vapor and the water upon exiting through the particulate outlet.

Aspect 13. The method of aspect 12, further comprising directing the resultant vapor stream to a regenerative thermal oxidizer.

Aspect 14. The method of any of aspects 12-13, wherein the water exiting through the particulate outlet is reintroduced into the vessel via one or more of the first water inlet, second water inlet, and third water inlet.

Aspect 15. The method of any of aspects 12-14, wherein the mist filter comprises stainless steel.

Aspect 16. The method of any of aspects 12-14, wherein the mist filter comprises a corrosion resistant material.

Aspect 17. The method of any of aspects 12-16, wherein the rate of introduction of water at a water inlet and the rate of exit of water through the water outlet is the same.

Aspect 18. The method of any of aspects 12-17, wherein the particulate size is from about 0.1 μm to about 10 μm.

Aspect 19. The method of any of aspects 12-17, wherein the particulate size is from 0.1 μm to 10 μm, from 0.1 μm to 10 μm.

Aspect 20. The method of any of aspects 12-17, wherein the particulate size is from about 0.1 μm to about 500 μm.

Aspect 21. The method of any of aspects 12-17, wherein the particulate size is from 0.1 μm to 500 μm.

Aspect 22. The method of any of aspects 12-21, wherein the system further comprises an aerator.

Aspect 23. A particulate removal system for removal of particulate in pre-combustion waste vapor, prepared by a process comprising: guiding a waste vapor into a housing defining an internal cavity having a vertical axis; directing a waste vapor into the internal cavity via a vapor inlet formed through the housing and configured to; separating water and a first amount of particulate from the waste vapor via a mist filter disposed in the internal cavity; introducing water into the internal cavity, the water mixing with the waste vapor as the waste vapor moves along the vertical axis of the internal cavity, the water introduced via a plurality of water inlets formed through the housing; directing at least a portion of the water and a second amount of particulate to exit the internal cavity via a particulate outlet formed through the housing; allowing at least a portion of the waste vapor to exit the internal cavity through a vapor outlet formed through the housing, wherein the waste vapor is processed in the internal cavity and the portion of the waste vapor exiting the internal cavity comprises less than 10 mg/Nm$^3$ of particulate.

While aspects of the present disclosure can be described and claimed in a particular statutory class, such as the system statutory class, this is for convenience only and one of skill in the art will understand that each aspect of the present disclosure can be described and claimed in any statutory class. Unless otherwise expressly stated, it is in no way intended that any method or aspect set forth herein be construed as requiring that its steps be performed in a specific order. Accordingly, where a method claim does not specifically state in the claims or descriptions that the steps are to be limited to a specific order, it is no way intended that an order be inferred, in any respect. This holds for any possible non-express basis for interpretation, including matters of logic with respect to arrangement of steps or operational flow, plain meaning derived from grammatical organization or punctuation, or the number or type of aspects described in the specification.

EXAMPLES

Detailed embodiments of the present disclosure are disclosed herein; it is to be understood that the disclosed embodiments are merely exemplary of the disclosure that may be embodied in various forms. Therefore, specific structural and functional details disclosed herein are not to be interpreted as limits, but merely as a basis for teaching one skilled in the art to employ the present disclosure. The specific examples below will enable the disclosure to be better understood. However, they are given merely by way of guidance and do not imply any limitation.

The following examples are provided to illustrate processes and properties of the present disclosure. The examples are merely illustrative and are not intended to limit the disclosure to the materials, conditions, or process parameters set forth therein.

A waste vapor stream from an HRG ABS production system was introduced into the vapor outlet of a scrubber system according to the conditions presented in Table 1.

TABLE 1

Conditions for operation of wet scrubber

| | Water Inlet | Outlet (Particulate outlet) Composition |
|---|---|---|
| | Water and particulate | Water and particulate |
| Circulating rate ($m^3$/hour) | 71*<br>40** | 1.0 |
| Temperature (° C.) | 60 | 60 |
| Pressure (kPaG) | 75*<br>207** | water flows by gravity |
| Specific gravity | 1.03 | 1.03 |
| Viscosity (centipoise, cP) | 1.0 | 1.0 |
| Maximum solids concentration (wt. %) | 3.0 | 3.0 |

*at venturi apparatus inlet (four spray nozzles).
**at inlet adjacent mist filter (two spray nozzles).

As shown in Table 2, the waste vapor stream introduced at a volume rate of 106,500 Actual meters cubed per hour ($Am^3$/hr) comprised 23.1 kg/hr of volatile organic compounds (VOCs) 18.15 kg/hour of particulate, of which 7.95 kg/hour was fine particulate having a particle size distribution of from about 0.1 μm to about 10 μm.

TABLE 2

Waste vapor stream at vapor inlet and at vapor outlet

| | Vapor Inlet | Vapor Outlet |
|---|---|---|
| Volume ($Am^3$/hr ) | 106,500 | 122,950 |
| Temperature (° C.) | 80 | 60 |
| Pressure (kPa) | 2.31 | ambient |
| Gas Density (kg/$m^3$) | 0.986 | 0.851 |
| Water vapor (kg/hr) | 6375.6 | 6723 |
| HRG Particulate (kg/hr) | 18.15 (total) [7.95 (fine)] | 10 mg/$Nm^3$ (fine particulate); 1.0 kg/hr total dust particulate |
| VOCs (kg/hr) | 21 | 21 |
| Specific gravity of HRG ABS | 0.48-0.64 | 0.48-0.64 |
| Total Gas Mass Flow(kg/hr) | 104,987 | 104,639 |
| Gas molecular weight (grams per mole, g/mol) | 27.92 | 27.92 |

Tables 3 and 4 presents the particle size distribution by percent for the particulate present in the waste vapor stream. Table 3 presents the particle size distribution of fine particulate, that is, particulate less than 10 μm in size. Table 4 presents the particle distribution of larger particulate within the vapor stream for particulate greater than 10 μm in size.

TABLE 3

Particle size distribution of vapor stream corresponding to fine particles

| Micron Range (μm) | Particle size distribution (%) |
|---|---|
| 0.1-0.133 | 0 |
| 0.133-0.178 | $1.13136 \times 10^{-5}$ |
| 0.178-0.237 | 0.000112189 |
| 0.237-0.316 | 0.000194083 |
| 0.316-0.422 | 0.000743195 |
| 0.422-0.562 | 0.000676923 |
| 0.562-0.75 | 0.002381065 |
| 0.75-1.0 | 0.007479290 |
| 1.0-1.33 | 0.005207101 |
| 1.33-1.78 | 0.015384615 |
| 1.78-2.37 | 0.052071006 |
| 2.37-3.16 | 0.094201183 |
| 3.16-4.22 | 0.285443786 |
| 4.22-5.62 | 1.737278099 |
| 5.62-7.5 | 13.06508870 |
| 7.5-10.0 | 84.73372745 |

TABLE 4

Particle size distribution of vapor stream corresponding to large particles

| Micron Range (μm) | Particle size distribution (%) |
|---|---|
| 10.0-13.3 | 8.18 |
| 13.3-17.8 | 20.62 |
| 17.8-23.7 | 32.57 |
| 23.7-31.6 | 30.02 |
| 31.6-42.2 | 8.61 |
| >42.2 | 0.00 |

The patentable scope of the disclosure is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed:

1. A system comprising a waste vapor from an acrylonitrile butadiene styrene process wherein the waste vapor comprises a particulate; a vessel comprising:

a. a vapor inlet configured to introduce the waste vapor stream into the vessel;

b. a mist filter disposed in the vessel and configured to minimize moisture within the waste vapor in the vessel;

c. a plurality of water inlets configured to introduce water into the vessel;

d. a particulate outlet configured to control exit of at least the water and the particulate from the vessel; and e. a vapor outlet configured to control exit of at least the waste vapor from the vessel;

and piping from the vapor outlet to a combustion system.

2. The system of claim 1, wherein the particulate has a size of from 0.1 μm to 10 μm.

3. The system of claim 1, wherein one or more of a first amount of particulate and a second amount of particulate comprises particulate having a size of from 0.1 μm to 10 μm.

4. The system of claim 1, wherein the mist filter comprises stainless steel.

5. The system of claim 1, wherein a rate of introduction of water at a water inlet of the plurality of water inlets and the rate of exit of water through the particulate outlet is the same.

6. The system of claim 1, wherein a rate of introduction of water at a water inlet and a rate of exit of water through the particulate outlet are configured such that there is no accumulation or depletion of water in the vessel.

7. A method using the system according to claim 1 for removal of particulate in waste vapor comprising:

guiding the waste vapor into the vessel having a housing, the housing defining an internal cavity oriented along a vertical axis;

directing the waste vapor into the internal cavity via the vapor inlet formed through the housing;

separating water and a first amount of the particulate from the waste vapor via the mist filter disposed in the internal cavity;

introducing water into the internal cavity, the water mixing with the waste vapor as the waste vapor moves along the vertical axis of the internal cavity, the water introduced via the plurality of water inlets formed through the vessel;

directing at least a portion of the water and a second amount of particulate to exit the internal cavity via the particulate outlet formed through the vessel; and allowing at least a portion of the waste vapor to exit the internal cavity through the vapor outlet formed through the housing, wherein the waste vapor is processed in the internal cavity and the portion of the waste vapor exiting the internal cavity comprises less than 10 mg/Nm3 of particulate wherein a normal cubic meter of gas corresponds to 1 cubic meter at 20° C. at 101.325 kPaA.

8. A method using the system according to claim 1 for removal of particulate in pre-combustion waste vapor of an acrylonitrile butadiene styrene process, the method comprising:

introducing a first stream of water into a first water inlet of a housing oriented on a vertical axis and having a first end and a second end, the housing having a vapor outlet and a particulate outlet, the vapor outlet disposed at the first end of the housing, and the particulate outlet disposed and the second end, and the housing having a mist filter disposed at the first end of the housing and adjacent the vapor outlet;

introducing a waste vapor into a vapor inlet of the vessel, the vapor inlet disposed between the particulate outlet and the mist filter;

introducing a second stream of water from a second water inlet into the vessel, the second water inlet disposed between the vapor inlet and the mist filter;

introducing a third stream of water from a third water inlet into the vessel, the third water inlet disposed between the mist filter and the vapor outlet;

directing the introduced waste vapor along the vertical axis from the vapor inlet through one or more of the first water stream, second water stream, and third water stream, and the mist filter, and through the vapor outlet to provide a resultant vapor stream;

and collecting a particulate from the waste vapor and the water upon exiting through the particulate outlet.

9. The method of claim 8, further comprising directing the resultant vapor stream to a regenerative thermal oxidizer.

10. The method of claim 8, wherein the water exiting through the particulate outlet is reintroduced into the vessel via one or more of the first water inlet, second water inlet, and third water inlet.

11. The method of claim 8, wherein the mist filter comprises a corrosion-resistant material.

12. The method of claim 8, wherein the mist filter comprises stainless steel.

13. The method of claim 8, wherein the rate of introduction of water at a water inlet and the rate of exit of water through the water outlet is the same.

14. The method of claim 8, wherein the rate of introduction of water at a water inlet and the rate of exit of water through the water outlet are configured such that there is no accumulation or depletion of water in the vessel.

15. The method of claim 8, wherein the particulate size is from 0.1 μm to 10 μm.

16. The system of claim 1 further comprising a dust collector through which the vapor stream passes prior to entering the vessel.

17. The system of claim 1 further comprising a dryer system and the vapor stream exits the dryer before entering the vessel.

18. The system of claim 1 wherein the particulate is present in the vapor stream entering the vessel an amount of at least 18 kg/hour.

19. The system of claim 1 wherein the particulate is present in the vapor stream exiting the vessel in an amount of less than 10 mg/normal cubic meter.

20. The system of claim 1 wherein the particulate comprises ABS.

* * * * *